United States Patent [19]

Czech et al.

[11] Patent Number: 5,039,587

[45] Date of Patent: Aug. 13, 1991

[54] OXIDE-COATED CARRIERS AND PREPARATION AND USE THEREOF

[75] Inventors: Erwin Czech, Biblis; Werner Ostertag, Gruenstadt; Detlef Schulze-Hagenest, Grasbrunn; Franz-Ulrich Schmitt, Gerlingen, all of Fed. Rep. of Germany

[73] Assignee: BASF Aktiengesellschaft, Ludwigshafen, Fed. Rep. of Germany

[21] Appl. No.: 404,072

[22] Filed: Sep. 7, 1989

[30] Foreign Application Priority Data

Sep. 13, 1988 [DE] Fed. Rep. of Germany ..... 3831091

[51] Int. Cl.[5] ..... G03G 9/113

[52] U.S. Cl. ..... 430/108; 428/404

[58] Field of Search ..... 430/108, 137; 428/404

[56] References Cited

U.S. PATENT DOCUMENTS

| | | | |
|---|---|---|---|
| 3,533,835 | 10/1970 | Hagenbach et al. . | |
| 3,632,512 | 1/1972 | Miller | 430/108 |
| 3,798,167 | 3/1974 | Kulka et al. . | |
| 3,863,108 | 1/1975 | Blythe et al. | 317/2 R |
| 4,310,611 | 1/1982 | Miskinis | 430/107 |
| 4,425,383 | 1/1984 | Creatura | 427/216 |
| 4,518,674 | 5/1985 | Watanabe et al. | 430/108 |
| 4,584,254 | 4/1986 | Makayama et al. | 430/108 |
| 4,590,141 | 5/1986 | Aoki et al. | 430/108 |
| 4,816,364 | 3/1989 | Oishi et al. | 430/108 |
| 4,925,762 | 5/1990 | Ostertag et al. | 430/108 X |

FOREIGN PATENT DOCUMENTS

| | | |
|---|---|---|
| 1103079 | 6/1981 | Canada . |

*Primary Examiner*—Roland Martin

*Attorney, Agent, or Firm*—Oblon, Spivak, McClelland, Maier & Neustadt

[57] ABSTRACT

A novel carrier which is stable and effective over long cycle times ($6\times10^6$ prints), has an iron oxide coating of the formula $(FeO)_x.Fe_2O_3$ where $x=0.1-1$ and is obtained by treating steel cores (or balls) with defined small amounts of sulfuric acid of defined concentration, partial oxidation of the cores thus treated and drying at 60°-150° C. at $\leqq 100$ mbar.

4 Claims, No Drawings

OXIDE-COATED CARRIERS AND PREPARATION AND USE THEREOF

Electrophotographically produced images today are predominantly developed with dry toners in a one-component or two-component system. The one-component system comprises a magnetizable toner. The developer in two-component systems customarily comprises magnetic carrier particles and nonmagnetic toner particles.

In electrophotography, a photoconductor coupled with charge carriers is selectively exposed to produce an invisible, latent image. To make this charge image visible, it must be developed. This is done by supplying a toner powder, which in the case of the two-component system consists essentially of a coloring component and binder and has particle sizes of from 5 to 13 μm. The toner powder is transported to the photoconductor via the magnetic brush, i.e. chains of carrier aligning with the electrical field lines along a sector magnet. The carrier, which carries the toner, is uniformly supplied to the photoconductor. This transport produces a controlled, electrostatic charge on the toner powder which can then be transferred to the photoconductor. Excess toner is brushed off the photoconducting layer by the carrier magnetic brush and conveyed back into the reservoir vessel. The developed toner image is then transferred to paper and fixed. The principle of the development process using two-component systems is well known, and described in detail for example in DE-C 2,404,982.

The carrier typically has a core whose material is magnetizable. The material can be made for example from iron, nickel, magnetite, $\gamma$-$Fe_2O_3$ or certain ferrites. Steel carriers, having excellent soft magnetic properties, are likewise still much in use today.

To instill the electrical and electrostatic properties required, the carrier particles usually carry a surface coating. This overcoat also has an effect on the mechanical properties. Spherical particles are particularly free-flowing. Irregular carrier shapes are used if a high electrostatic charge is desired. The toner particles are charged to the desired extent by electron exchange processes or alternatively ion transfers [K. L. Birkett and P. Gregory, Dyes and Pigments 7 (1986), 341], which are mutually induced by the friction between toner and carrier particles (triboelectric effect). Since the toner particles are in vigorous mechanical interaction with the carrier surface, the desired charge exchange processes, however, are also accompanied by undesirable side effects such as abrasion and impaction on the surface. Abrasion occurs not only at the toner but also at the carrier surface due to the intense frictional interaction. Minuscule particles abraded off the toner impact on the carrier surface, reducing carrier activity as evidenced by the continuous loss, or exhaustion, of the ability of the carrier to charge the toner particles to a certain level. The result is that the printed image deteriorates.

To prevent toner impaction on the carrier surface, it was customary in the past to use plastics having low surface energies, for example silicone resins (e.g. U.S. Pat. No. 3,562,533), or hydrofluorocarbon-containing polymers (e.g. U.S. Pat. No. 3,533,835). The mechanical stability of such carrier coatings nonetheless left something to be desired. There was therefore a general shift toward improving the abrasion resistance by means of fillers such as silicon carbide, potassium titanate (DE-A 3,312,741), chromium oxide or iron oxide (U.S. Pat. No. 3,798,167), or other metal oxide compounds. Because most polymers have an excessively high electrical resistance it was also necessary to add conductive components. Although this measure ensures that the surface is mechanically stable, the toner particles abrade in the course of transportation, generating detritus which goes on to the surface of the carrier, becoming compacted thereon and as a result reducing the activity of the carrier. To eliminate this disadvantage, it has been attempted to make good the decreasing activity of the carrier by means of a coating which contains for example organotin compounds with concentration gradients within the layer (DE-A 3,511,171). This layer acts as a catalyst in the curing of the silicone resin and in a way makes good the loss of carrier activity incurred in the case of a specific toner. However, the preparation of such layers is only possible by a complex process and must be adapted to the viscoelastic characteristics of the toner in question.

Fundamental studies concerning exhaustion and triboelectricity have been carried out. In these studies, the phenomenon of toner impaction was investigated as a function of toner particle size, carrier particle size, the coating on the toner and the level of toner on the carrier (R. J. Nash and J. T. Bickmore, "Toner impaction and triboelectric aging", Paper Summaries of the 4th Congress on Advances in Non-Impact-Printing Technologies, p. 84, March 1988, New Orleans). The results of these studies can be summarized as follows: smaller toner particles, smaller carrier particles and hydrophobic silica coatings on the toner prolong the life of the developer.

Steel carriers having certain electrical properties are known. According to U.S. Pat. No. 3,632,512, steel balls are anoxidized in a defined manner by treatment with 2N sulfuric acid; according to CA-A-1,103,079, they are oxidized by heat treatment. These carriers have an oxide layer on their surface. The treatment of steel balls with 2N sulfuric acid as described in U.S. Pat. No. 3,632,512 is associated with appreciable water pollution, and industrial implementation is difficult and expensive because of the complicated drying. The carriers obtained by this process have very homogeneous overcoats, they improve the charge distribution and they ensure a better print.

The purpose of these surface treatments is to obtain very abrasion-resistant coatings as well as good electrical properties (average specific resistances of from $10^{-1}$ to $10^{-8}$ $\Omega.cm^{-1}$). The decrease in carrier activity can be delayed owing to the low affinity of the iron oxide layer for the toner resin. Nonetheless, a continuous decrease in carrier activity is likely since the toner resin particle detritus, owing to the electrostatic charge, initially remains on the carrier surface and is increasingly compacted thereon by the tumbling motion of the carrier particles. However, the question arises whether the phenomenon of exhaustion cannot be delayed in some fundamentally different way.

It is a basic disadvantage of all existing carrier developers that carrier activity continuously decreases; that is, the print is constantly changing over the life of the developer. To prevent this, the carrier surface must be continuously regenerated in order to retain its original character over many thousand copying cycles.

It is an object of the present invention to prepare steel carriers having an oxidic surface which becomes continuously regenerated in use, ensuring a long life of consistently high print quality. Furthermore, the process should be inexpensive and environmentally safe.

We have found that this object is achieved by the carrier of the invention.

The present invention accordingly provides a carrier which has an iron oxide surface coating of the formula $(FeO)_x \cdot Fe_2O_3$ (x=0.1-1) on steel cores and is obtainable by treating the steel cores (or balls) with aqueous sulfuric acid using $m^2$ of ball surface area from $5\times10^{-5}$ to $2.5\times10^{-4}$ mol of sulfuric acid, the acid concentration at the start of the treatment being from $10^{-2}$ to $10^{-6}$ mol/l, oxidizing the balls which have been treated with sulfuric acid with oxygen or an oxidizing agent in an amount which corresponds to from $5\times10^{-5}$ to $5\times10^{-4}$ oxidation equivalent/$m^2$ of ball surface area, and drying the balls at from 60° to 150° C. under a pressure of $\leqq$100 mbar.

The carrier of the invention has a surface which conforms to the material composition $(FeO)_xFe_2O_3$. The novel carrier has a surface where the process of abrasion performs the important function of cleaning and renewing the carrier particle surface.

The surface of the carrier according to the invention comprises an approximately 0.3 μm thick, largely X-ray amorphous iron oxide layer whose composition of $(FeO)_xFe_2O_3$, where x is $0.1\leqq x\leqq 1$ was determined by wet-chemical analysis of collected samples of detritus. If concentration profiles were obtained by ablating the carrier surface with argon plasma a scanning auger microprobe was used to determine the decrease oxygen concentration from the outside toward the inside. The results were compared with those of carriers which have an artificially vacuum vapor deposited iron oxide film of a defined thickness. The layer thickness was found to be about 0.3±0.1 μm. Weak X-ray lines indicate that the oxidic surface has a spinal structure.

The surface layer of the carrier of the invention consists of intergrown, predominantly plateletlike oxidation products of the iron surface, the platelets being on average from 0.05 to 0.1 μm in size and about 10-50 nm in thickness. The platelets are only intergrown at the edges, so that a breaking out of individual particles is possible under mechanical stress.

The developer composed of toner and a carrier according to the invention can as it were be described as a three-component system composed of toner, carrier and detritus. Using the specific coating technique of the invention made it possible to produce an oxidic surface layer which in the course of the copying process produces small amounts of abrasive iron oxide particles.

The iron oxide particles 0.05-0.1 μm in size emanating from the carrier surface are initially kept as detritus on the carrier surface by the large forces of adhesion. On the carrier surface they can combine with the toner detritus and thus facilitate the detachment thereof from the carrier surface.

The novel carrier is produced by subjecting the uncoated steel carrier to specific treatment with aqueous sulfuric acid, oxidizing and finally drying. In the acid treatment, 0.05-0.25 mmol of acid is used per $m^2$ of steel carrier surface area, the acid concentration at the start of the treatment being from $1\times10^{-2}$ to $1\times10^{-6}$ mol/l; that is, the pH must not be less than 2. In a particularly advantageous procedure, the initial pH is 3.5-4.5. It was found that from $5\times10^{-5}$ to $2.5\times10^{-4}$ mol of sulfuric acid is required per $m^2$ of surface area in order to produce a surface coating of optimal thickness. If small amounts of acid are used in the treatment, then a small effect is observed, compared with the uncoated material, in respect of the electrostatic charge distribution. Excessively large amounts of acid lead to products which are not very stable to storage: the coating is too brittle and the carrier may corrode.

Sulfuric acid is preferred since sulfate ions do not reduce the shelf life of the steel balls. The use of other mineral acids is possible, but, for example in the case of hydrochloric acid, leads to corrosion problems. If dilute nitric acid is used, the iron(II) ions formed undergo uncontrolled oxidation.

This sulfuric acid treatment and the partial oxidation of the Fe(II) ions may be carried out in succession or, alternatively, simultaneously. The partial oxidation can be effected for example with oxygen-saturated water or acid solution or alternatively by the addition of an alkali metal permanganate in a normality of from $5\times10^{-5}$ to $5\times10^{-4}$ mol per $m^2$ of surface area. However, the oxidation can also be carried out with other oxidizing agents such as hydrogen peroxide and ammonium peroxodisulfate.

Preferably, the acid treatment and the oxidation are carried out simultaneously, in particular with oxygen-saturated sulfuric acid or permanganate-containing sulfuric acid. The oxidation of the resulting iron(II) hydroxide, however, can also be effected with oxygen-containing gases, preferably air, after the sulfuric acid treatment.

The amount of oxidizing agent is from $5\times10^{-5}$ to $5\times10^{-4}$ oxidation equivalent per $m^2$ of steel carrier surface. The oxide-coated carrier is dried at 60°-150° C. and pressures $\leqq$100 mbar. If the product is dried at 70° C. it will change its color after a few days. However, the effect remains the same (see Example 3). Preference is given to carriers which are dried above 100° C. Owing to the extremely low sulfuric acid concentration, the process is environmentally very safe.

The raw material used, i.e. the steel carrier, was for example a steel ball product available from Metallurgica Toniolo S.p.A., Maerne, Italy, under the trade designation TC 100. These steel balls consist of 98.5% of Fe, 0.4% of Mn, 0.4% of Si, 0.1% of each of Ni, Cr and Cu, and traces of Co, Zn, Mg and Ca. However, it is also possible to use a raw carrier material having an irregular particle shape. Particular preference is given to steel carriers which have been produced by spray atomizing.

The studies concerning carriers which have satisfactory performance characteristics show that a carrier will always produce a good print and be considered fully satisfactory if the electrostatic chargeability of the toner particles present in the developer has a narrow distribution (q/d). The electrostatic chargeability distribution was measured with a q/d meter (from Epping GmbH, Neufahrn). The method of measurement exploits the different settling rates of toner particles having different q/d values (q: charge on toner particle, d: diameter of a toner particle) on an electrode in an electric field. In addition, the toner concentration in the developer must not change; that is, the number of toner particles on the carrier should remain substantially the same over the period of use; it must not increase or decrease, apart from minor variations.

The stress or lifetime test to establish whether the carrier was fully satisfactory was carried out under realistic conditions in an ND2 laser printer (from Siemens AG, Munich). This printer consumed on average 350 g of toner per hour when filled with 8 kg of developer. The specific toner consumption was accordingly 43.8 g of toner per kg of developer per hour.

When 3 million prints had been produced, the carrier in the developer had been in use for about 600 hours. During this time about 210 kg of toner were consumed, i.e. 26.3 kg of toner per kg of developer.

Even after the novel carrier present in the developer had been in use for about 1200 hours, there were no signs of deterioration in the print; that is, after over 6 million prints the carrier according to the invention was still fully effective.

By comparison, a carrier prepared as described in Example 1 of U.S. Pat. No. 3,632,512 showed distinct signs of fatigue after just 3 million prints, as evidenced by a marked deterioration in the print and a disproportionate buildup of toner in the developer. If the q/d distribution of the toner particles present in this exhausted developer is determined, it is found that, compared with the toner in the still fully functioning developer which contains the carrier according to the invention, the charge distribution is distinctly broader after 3 million prints.

To corroborate the novel concept of the self-regenerating carrier surface and the important role of the detritus, an uncoated steel carrier was admixed with finely divided, largely amorphous iron oxide to prepare a developer.

In the initial phase (for about 6 hours) this developer performed perfectly well in the laser printer. The print proved fully satisfactory and, judged by the above test, the toner particles present in the developer had a narrow charge distribution (q/d measurement). However, with time and very plainly after the artificially added iron oxide detritus had been removed the developer presently became exhausted. The print deteriorated and the toner particles in the developer had a broad charge distribution. By analyzing for iron in the toner it was possible to show that the developer based on the carrier of the invention forms detritus at a uniform rate over its entire lifetime.

The invention is further illustrated by the following Examples:

EXAMPLE 1

A 1000-ml stirred vessel equipped with a pH electrode, a blade stirrer, a sieve plate and inlet and outlet means is charged with 1000 g of steel powder (steel powder TC 100, from Toniolo, Maerne, Italy) having a particle size distribution of 75–175 μm, a weight average particle size of 105 μm and a surface area of 36 $cm^2g$. In a feed vessel, 4 l of a sulfuric acid solution at pH 4 is saturated with air (0.0205% by volume of $O_2$ in water at 15° C.) by introducing an air stream at 100 l/h. The solution is then pumped at a rate of 20 l/h through the dumped steel powder. The solution which runs off is recycled into the feed vessel, while the pH in the feed vessel and the reactor is measured continuously. Air is blown into the feed vessel at a rate of 100 l/h. After about 20 minutes the pH in the feed vessel has risen to 8 and no longer differs from the pH in the reaction vessel.

The slightly yellow solution is discharged from the reactor. The reactor vessel is then connected to a vacuum pump, heated with 4 bar steam to 135° C. and dried under a pressure of 55 mbar in the course of 4 hours. The very free-flowing, slightly yellow steel powder is then discharged from the reactor and can be used to prepare the developer.

COMPARATIVE EXAMPLE 1

The directions of Example 1 of U.S. Pat. No. 3,632,512 were followed to prepare a carrier from the steel balls used in Example 1. To this end, the steel balls were treated with 2N sulfuric acid, then washed with water and methanol as described in the Example and then IR-dried at 80° C. in the presence of air.

EXAMPLE 2

A 1000-ml stirred vessel equipped with a pH electrode, a blade stirrer, a sieve plate and inlet and outlet means is charged with 1000 g of steel powder (steel powder TC 100 from Toniolo, Maerne, Italy) using a particle size distribution of 75–175 μm, a weight average particle size of 105 μm and a surface area of 36 $cm^2/g$. Thereafter, 4 l of sulfuric acid solution at pH 4, in which $1.3\times10^{-5}$ mol/l of potassium permanganate has been dissolved, is pumped with stirring at a rate of 20 l/h through the dumped steel powder. The solution which runs off is recycled into the feed vessel and the pH in the feed vessel and the reactor is measured continuously. After about 15 minutes the pH in the feed vessel has risen to 8 and is no longer different from the pH in the reaction vessel.

The slightly brown solution is discharged from the reactor. The reactor with its steel ball contents is then evacuated (55 mbar) and heated, with the vacuum pump running, to 120° C., and the product is dried for 4 hours. Thereafter the very free-flowing, slightly yellow steel powder is discharged from the reactor. It can be used directly for preparing the developer.

EXAMPLE 3

A 1000-ml stirred vessel equipped with a pH electrode, a blade stirrer, a sieve plate and inlet and outlet means is charged with 1000 g of steel powder (steel powder TC 100, from Toniolo, Maerne, Italy) having a particle size distribution of 75–175 μm, a weight average particle size of 105 μm and a surface area of 36 $cm^2/g$. In a feed vessel, 4 l of sulfuric acid solution of pH 3 is prepared. The solution is then pumped at a rate of 20 l/h through the dumped steel powder. The solution which runs off is recycled into the feed vessel, while the pH in the feed vessel and the reactor is measured continuously. After about 17 minutes the pH in the feed vessel has risen to 8 and is no longer different from the pH in the reaction vessel.

The slightly yellow solution is discharged from the reactor. The reactor is then evacuated. Thereafter, with the vacuum pump running, 100 ml of air is passed through the moist iron powder bed in the course of 5 minutes. The air supply is then terminated and the moist carrier is discharged from the reaction vessel under a nitrogen blanket. One-third portions of the moist carrier were dried at 70°, 100° and 130° C. respectively in an evacuable drying cabinet for 4 hours.

After cooling, the samples were conditioned at 85% relative humidity at 25° C. for 1 week.

The color of the carrier dried at 70° C. changed from yellow to a rusty red. However, the electrostatic chargeability corresponds to that of the carrier dried at 130° C. The samples dried at 110° and 130° C. do not show any color change, and the electrostatic charge distribution corresponds to that of Example 2.

Developer 1

The developer is prepared by accurately weighing out 988 g (98.8% by weight) of the carrier prepared as described in Example 1 and 12 g (1.2% by weight) of original toner for the ND2/ND3 Siemens laser printer (Siemens AG, Munich) and subsequent activation. To this end, the mixture is agitated for 5 minutes in a 500-ml glass flask on a roll block at 60 rpm.

Developer 2

For comparison, a developer was prepared from 98.8% by weight of the steel carrier obtained as described in Comparative Example 1 and 1.2% by weight of toner for Siemens laser printer ND2/ND3 and activated in the same way as developer 1.

Developer 3

For comparison, a developer is prepared from 98.8% by weight of uncoated steel balls (TC 100) and 1.2% by weight of toner for Siemens laser printer ND2/ND3. Activation was as for developer 1.

Developer 4

An uncoated carrier (TC 100) was mixed with 0.005% by weight of a finely divided iron oxide (Sicotrans Orange L 2515, BASF AG, Ludwigshafen) and the mixture was shaken for 15 minutes in a red devil. Thereafter a developer is prepared by mixing 98.8% of carrier thus prepared and 1.2% by weight of toner for Siemens laser printer ND2/ND3.

Determination of the Electrostatic Chargeability q/m

The activated developer (charge separation by triboelectricity) is accurately weighed out and introduced into a measuring cell capped at the top and the bottom with sieve inserts.

The mesh size at 50 μm is such that all the toner particles can pass through it while all the carrier (75–175 μm) remains on the inside of the measuring cell. The measuring cell, which has a cylindrical shape, is insulated and coupled to an electrometer (q/m meter, Epping GmbH, Neufahrn). By means of a fast air stream of about 4000 $cm^3$/min and simultaneous aspiration, the toner, which adheres electrostatically to the carrier, is completely removed from the carrier particles and blown out of the cell. The charge can be read off on the electrometer. The amount of charge of opposite sign then corresponds to the charge on the blown-off toner, the mass of which is determined by backweighing the measuring cell. In the printer, the developer is activated in the course of magnetic brush development by the toner particles which glide along the carrier chains. The degree of charge separation depends on the materials used and on the duration and intensity of activation. Very strong vibratory movements can destroy a developer, since either the coatings are rubbed off or the toner impacts on the carrier surface.

Experiment 1

Determination of q/m 600 g of developer 1 are introduced into a laser printing LD tester (from Epping, GmbH, Neufahrn near Munich). Toner for Siemens laser printer ND2/ND3 is introduced into the reservoir vessel. The speed of the magnetic brush is 15 cm/sec. The distance to the photoconductor is 2.0 mm. The speed of the semiconductor drum is 7 cm/sec., and the potential between the conductor and developer roll is 300 V. The amount of toner transferred is aspirated away on the other side of the photoconductor. After a few minutes the process of development is interrupted and a sample of developer 1 is taken. A q/m measurement is carried out. The q/m measurement is found to be 15.5±1.0 μC/g (Table 1).

The deviation was determined in this experiment as in the other experiments as the arithmetic mean of 10 runs.

The q/m values of comparative developers 2, 3 and 4 were determined by the same method. The measurements are summarized in Table 1.

Results

The average electrostatic chargeability of developer 1, 2 and 4 are the same within the margin of error. Developer 3, which is based on an uncoated carrier, has a very high charge compared to the other developers.

Experiment 2

20 g of developer 1 are activated in a 50 ml glass flask on a 60 rpm roll block for 10 minutes. Then a q/d measurement (q/d meter, Epping GmbH, Neufahrn) was carried out. The average q/d value was 6.9±3.6 fC/10 μm with a standard deviation of 4.0±0.5. The same method was used to carry out q/d measurements on developers 2, 3 and 4. The results are summarized in Table 1.

Experiment 3

Determination of the Amount of Toner in Developer 1 Under Operating Conditions.

8000 g of developer 1 were introduced into an ND2 laser printer (from Siemens AG, Munich) and operated under customary conditions. The blackness and quality of the print were monitored. After every 500,000 prints the iron content of the toner transferred to the paper was analyzed. A sample of the developer was taken after 3 million prints to determine the total toner concentration. It was found to be 1.8%. After 6 million prints the developer was removed from the machine to determine its total toner concentration. It was found to be 3.6%.

Experiment 4

Determination of the Amount of Toner in Developer 2 Under Operating Conditions

As in experiment 3, 8000 g of developer 2 were introduced into an ND2 laser printer and the printer was operated as in experiment 3. After every 500,000 prints toner samples were taken to determine the iron content. After 3 million prints the total toner concentration was already 5.6%.

The experiment was then discontinued.

The results are summarized in Table 2.

Experiment 5

Determination of the Amount of Toner in Developer 3 Under Operating Conditions

Developer 3 was tested in a laser printer as described in experiment 3. The run had to be discontinued after just a few thousand prints because of the poor quality of print. The results are summarized in Table 2.

Experiment 6

Determination of the Amount of Toner in Developer 4 Under Operating Conditions Developer 4 was tested in a laster printer as described in experiment 3. The developer produced over 5000 clean, satisfactory prints. Then the quality of print deteriorated dramatically, so that the run had to be discontinued. The results are summarized in Table 2.

TABLE I

| Electrostatic chargeabilities of developers | q/m in μC/g | Average q/d in fC/10 μm | Standard deviation |
|---|---|---|---|
| Developer 1 (according to the invention) | 15.5 | 6.9 | 3.6 |
| Developer 2 (carrier according to U.S. Pat. No. 3,632,512) | 16.0 | 7.2 | 4.0 |
| Developer 3 (uncoated steel carrier) | 36.5 | 13.9 | 5.9 |
| Developer 4 (steel carrier coated with finely divided iron oxide) | 14 | 7.0 | 3.4 |

TABLE 2

| Results of the printing test | Developer 1 | Developer 2 | Developer 3 | Developer 4 |
|---|---|---|---|---|
| Image quality + blackness by densitometric measurement of a reference sample | | | | |
| After 1000 prints | good 0.48 | good 0.47 | too strong 0.53 | good 0.48 |
| After 10,000 prints | normal 0.53 | normal 0.51 | inadequate — | inadequate — |
| After 100,000 prints | normal 0.52 | normal 0.55 | — | — |
| Thereafter | normal 0.53 | normal 0.52 | | |
| Iron content in toner | | | | |
| after 1000 prints | 1.0 ppm | 0.5 ppm | — | 1 ppm |
| after 500,000 prints | 1.06 ppm | <0.1 ppm | — | — |
| 1 million prints | 0.8 ppm | <0.1 ppm | — | — |
| 1.5 million prints | 1.5 ppm | <0.1 ppm | — | — |
| 2 million prints | 0.9 ppm | <0.1 ppm | — | — |
| 2.5 million prints | 0.7 ppm | <0.1 ppm | — | — |
| 3 million prints | 0.9 ppm | <0.1 ppm | — | — |
| 3.5 million prints | 1.0 ppm | <0.1 ppm | — | — |
| 4 million prints | 0.7 ppm | <0.1 ppm | — | — |
| 4.5 million prints | 0.6 ppm | <0.1 ppm | — | — |
| 5 million prints | 0.5 ppm | <0.1 ppm | — | — |
| 5.5 million prints | 0.7 ppm | <0.1 ppm | — | — |
| 6 million prints | 0.8 ppm | <0.1 ppm | — | — |
| Total toner concentration | | | | |
| At the start | 1.2 | 1.2 | 1.2 | 1.2 |
| After 3 million prints | 1.8 | 5.6 | — | — |
| After 6 million prints | 3.6 | — | — | — |

We claim:

1. A carrier which has an iron oxide surface coating of the formula $(FeO)_x \cdot Fe_2O_3$ (x=0.1–1) on steel cores and is obtainable by treating the steel cores (or balls) with aqueous sulfuric acid using per $m^2$ of ball surface area from $5\times10^{-5}$ to $2.5\times10^{-4}$ mol of sulfuric acid, the acid concentration at the start of the treatment being from $10^{-2}$ to $10^{-6}$ mol/l, oxidizing the balls which have been treated with sulfuric acid with oxygen or an oxidizing agent in an amount which corresponds to from $5\times10^{-5}$ to $5\times10^{-4}$ oxidation equivalent/$m^2$ of ball surface area, and drying the balls at from 60° to 150° C. under a pressure of ≦100 mbar.

2. The carrier of claim 1, wherein the treatment with sulfuric acid and the oxidation are carried out simultaneously.

3. The carrier of claim 1, wherein the oxidation is carried out with atmospheric oxygen or with an alkali metal permanganate.

4. The carrier of claim 1, wherein the steel cores (or balls) have been produced by the technique of spray atomizing.

* * * * *